United States Patent [19]

Parker

[11] 4,305,687

[45] Dec. 15, 1981

[54] ANCHORING SYSTEM FOR ROCK BOLTS

[76] Inventor: Jack Parker, 87 Maple, White Pine, Mich. 49971

[21] Appl. No.: 6,679

[22] Filed: Jan. 26, 1979

[51] Int. Cl.[3] ..... E21D 20/02

[52] U.S. Cl. ..... 405/260

[58] Field of Search ..... 405/259, 260, 261, 262; 85/86, 78, 69, 68, 63, 65

[56] References Cited

U.S. PATENT DOCUMENTS

| | | | |
|---|---|---|---|
| 1,265,866 | 5/1918 | Ackerman | 85/69 |
| 2,351,449 | 6/1944 | Noble | 405/260 X |
| 2,682,152 | 6/1954 | Bieber | 405/260 |
| 2,849,866 | 9/1958 | Flygare et al. | 405/261 |
| 2,952,129 | 9/1960 | Dempsey | 405/261 |
| 3,188,815 | 6/1965 | Schuermann et al. | 85/63 UX |
| 3,244,055 | 4/1966 | Schuermann et al. | 405/259 X |
| 3,308,585 | 3/1967 | Fischer | 85/63 X |
| 3,349,567 | 10/1967 | Munn | 405/259 |
| 3,363,422 | 1/1968 | Turzillo | 405/260 |
| 3,753,354 | 8/1973 | Bauer | 405/260 |
| 3,837,258 | 9/1974 | Williams | 405/260 X |
| 3,896,627 | 7/1975 | Brown | 85/63 |
| 3,940,941 | 3/1976 | Libert et al. | 405/261 |

FOREIGN PATENT DOCUMENTS

| | | | |
|---|---|---|---|
| 1100773 | 9/1955 | France | 405/259 |
| 1024696 | 3/1966 | United Kingdom | 405/260 |
| 601425 | 4/1978 | U.S.S.R. | 405/260 |

*Primary Examiner*—Dennis L. Taylor

*Attorney, Agent, or Firm*—Merchant, Gould, Smith, Edell, Welter & Schmidt

[57] ABSTRACT

An anchoring system for rock bolts which support and reinforce rock structures, primarily roof structures in underground mines. The anchoring system involves the coaction of: (1) a hardenable grout such as a synthetic resin; and (2) a simple but specially designed rock bolt which has a frustum or wedge portion or element at its inner end. In this system, the wedge is secured to or forms a part of the rock bolt and the bolt is anchored by the direct mechanical action of the wedge against the hardened grout, with the wedge causing the grout to be placed under compression as the wedge slides through the grout. The anchoring is accomplished without changing the position of movable mechanical parts and without grouting along the entire length of the rock bolt. The rock bolt anchoring system is used by drilling a hole in a rock formation, introducing into the hole an anchoring amount of a hardenable grout in an amount which is sufficient to fill the hole in the zone occupied by the anchoring wedge but which is substantially less than the amount of grout required to grout the entire rock bolt, simultaneously or subsequently inserting the specially designed rock bolt into the hole, permitting or causing the grout to harden in the hole while the grout is in contact with the wedge shaped portion of the rock bolt, and then imparting tensile forces to the rock bolt by tightening the rock bolt against a suitable bearing plate or other restraining device located at or near the outer end of the rock bolt.

19 Claims, 10 Drawing Figures

ANCHORING SYSTEM FOR ROCK BOLTS

TECHNICAL FIELD

This invention relates to an anchoring system for rock bolts which are used to support or reinforce rock structures such as those found in underground mines and various civil engineering projects.

BACKGROUND OF PRIOR ART

For a number of years, specialized mechanical devices called "bolts" have been used to support or reinforce rock structures, primarily roof structures in underground mines. They are believed to work in two ways. First, the bolt can be anchored in strong rock which has the ability to support the load of weaker rock below it. Here, the weak rock in the immediate ceiling is essentially suspended by the bolt from the stronger rock above it. Second, and perhaps the more prominent effect, the rock between the two ends of the bolt is compressed, exerting a horizontal force which, essentially, builds a beam of rock which forms the roof of the mine. Theoretically, the more tension on the bolt, the stronger the beam, and less chance of roof fall.

Although the mechanism of rock bolting is not yet fully understood, the method of use is relatively straight forward. In its simplest form, rock bolting involves drilling or otherwise forming one or more holes (often they are generally vertical) in an overhead rock formation. The diameter of each hole is generally small, typically on the order of 2–6 centimeters. In the United States, hole diameters are typically $1\frac{3}{8}$ inch to $1\frac{3}{4}$ inch. A specially designed rock bolt is then inserted into the hole. A typical rock bolt involves a partially threaded shaft, the inner (or buried) end of which is engaged (e.g. threadably engaged) with some form of operable anchoring device (e.g. an expandable anchor having several moving parts) which can be manipulated to anchor the rock bolt in the hole. Rock bolts are typically 100–300 centimeters in length, although much longer bolts (e.g. 1500 cm) are used in some civil engineering projects. After the rock bolt is pushed into its hole, the bolt rod is rotated about its longitudinal axis or otherwise manipulated so that the anchoring device is expanded or forced outwardly against the inside wall of the hole. The outer (or exposed) end of the rock bolt is firmly fastened over the end of the hole by some type of collar or bearing plate or similar device which is held in place by means of an integral head or a threaded nut on the outer end of the shaft of the rock bolt. As a consequence, the bolt is firmly anchored in the hole by the wedging action that has occurred at the upper end of the rock bolt and the bolt itself is placed under considerable tension as the nut or head on the lower end is tightened. By careful placement and proper tightening of a series of rock bolts, it is possible to support or reinforce a variety of rock structures. If desired, the rock bolt can be protected against chemical attack and also more securely fastened into the rock formation by pumping or otherwise introducing a hardenable grout into the hole, usually along the entire length of the bolt after the bolt has been tensioned.

The concept of rock bolting can be better understood by reference to several of the drawings (in which the straight diagonal lines are used to indicate rock formations and not fracture lines).

SUMMARY OF THE INVENTION

The present invention is an improved anchoring system for rock bolts of the type used for supporting and reinforcing rock formations, primarily roof structures in underground mines. The present anchoring system involves the coaction of: (1) a hardenable grout such as a synthetic resin; and (2) a specially designed rock bolt which has a wedge or frustum formed at its inner end. In this system, the wedge is secured to or forms a part of the rock bolt. The bolt is anchored by the direct mechanical action of the wedge against the hardened grout, with the wedge causing the grout to be placed in compression as the wedge slides through the grout. There is no forced expansion of the wedge anchor.

The present invention is unique in that it does not require a plurality of moving mechanical parts or an expandable shell to form the anchor and yet the anchorage is concentrated at or along the inner end of the bolt and is not spread along the entire bolt shaft as in the case of rebars which are usually grouted along their entire length. In one sense, the rock bolt anchors of the present invention are grout-activated and free-floating (when embedded in the grout).

The present bolt anchoring system is used by drilling a hole (often vertical) in a rock formation, introducing into the hole an anchoring amount of a hardenable grout, which amount is sufficient to fill the hole in the zone occupied by the anchoring wedge but which is substantially less than the amount of grout required to grout the entire rock bolt, simultaneously or subsequently inserting the specially designed rock bolt (with anchor) into the hole, permitting or causing the grout to harden in the hole while the grout is in contact with the wedge-shaped anchor portion of the rock bolt, and then imparting tensile forces to the rock bolt by tightening the rock bolt against a suitable bearing plate or other restraining device located at or near the outer end of the rock bolt.

The specially shaped bolt has its upper or anchoring end shaped like a wedge which can be an inverted, truncated cone or other frustum (or a series of them), with the thickest part of each cone or wedge section being closer to the anchoring end of the bolt when compared to the narrowest portion of each cone or wedge. Desirably, the special bolt-end is finished, polished or treated to minimize any adhesive bonding to the grout. When tension is applied to the opposite or outer end of the bolt, (initially by tightening a nut; later as load is added to the bolt), the cone or wedge-shaped end of the bolt slides within the grout and the wedges bear outwardly against the hardened grout, thereby compressing the grout against the rock, causing the combined action of the grout and wedges to resist the tensile forces on the bolt.

Advantages of the present rock bolt system include:

(1) There is no need to use a separate or complex moveable or expandable mechanical anchor, so money is saved.

(2) The grout provides a bearing surface over a high percentage of the working surface of the anchoring cone or wedge, thereby offering much more resistance to movement than does a mechanical anchorage with its limited contact area with rock.

(3) The cones or wedges load the grout in compression so that the grout can provide much more resistance to movement than when it is loaded only in shear, as it usually is in a normal resin- or cement grout-anchored bolt. Compressively loaded grout is more resistant to failure by internal shear.

(4) Only a small amount of grout is needed.

(5) There is no need to fill the entire hole with either steel or grout as in normal resin-bolting, so costs can be reduced.

(6) The cost advantages of drilling small diameter holes (as claimed for resin bolting versus mechanical bolting) also apply to the present system.

(7) The grout can be made to set up in minutes, thereby giving almost instant anchorage.

DETAILED DESCRIPTION

Figure 1:
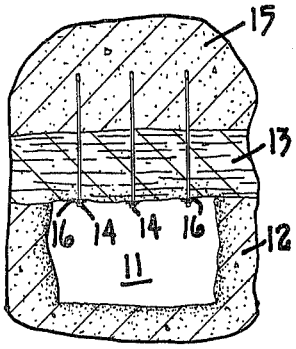
FIG. 1 is a cross-sectional view of a horizontal mine opening having a thick but weak horizontal rock structure for its roof.

Turning now to FIG. 1, FIG. 1 is a cross sectional view of a horizontal mine opening 11 which is surrounded by a rock formation 12. The roof of the mine opening is formed from a horizontal rock structure 13 which is weak and potentially unstable. As shown in FIG. 1, the horizontal rock structure 13 is reinforced through a mechanism known as "suspension" by anchoring the upper ends of a series of rock bolts 14 into a competent rock horizon 15 with the lower ends of the bolts 14 each being tightened against bearing plates 16. In this fashion, the rock bolts 14 suspend or support the weak horizontal rock formation 13.

Figure 2:
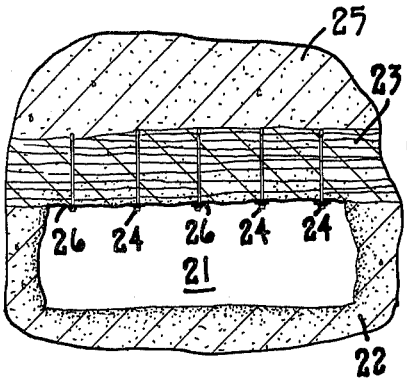
FIG. 2 is a cross-sectional view of a horizontal mine opening having a roof structure formed of a series of thin horizontal layers of rock.

FIG. 2 illustrates the use of rock bolts to form a beam by clamping or doweling together several thin layers of rock to thereby form a thicker, more competent beam. As shown in FIG. 2, a horizontal mine opening 21 is surrounded by rock walls and floor 22. The roof is formed from a number of thin layers of rock 23 which are clamped together by means of a series of roof bolts 24 to form a beam. The upper ends of the rock bolts 24 are anchored high in the horizontal rock formation 23 while the lower ends are tightened against bearing plates 26 to thereby reinforce the roof structure of mine opening 21.

Figure 3:
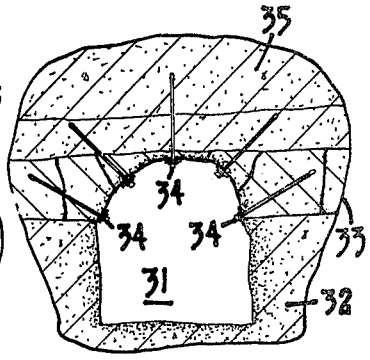
FIG. 3 is a cross-sectional view of a horizontal mine opening having a dome-shaped roof formed of irregular rock chunks.

FIG. 3 illustrates the use of rock bolts to key or interlock irregularly shaped chunks of rocks together so that they cannot readily slide past each other, thereby building a more competent, stable rock mass. As shown in FIG. 3, a horizontal mine opening 31 has its side walls and floor formed in rock formation 32. The roof of the mine opening 31 is dome-shaped and has been cut into rock formation 33, similar to an arch. A number of rock bolts 34 are used to key or dowel chunks of rock formation 33 together so that they cannot freely slide past each other. In some cases, the uppermost ends of anchors 34 penetrate through the overhead rock formation 33 into the more competent horizon 35.

Figure 4:
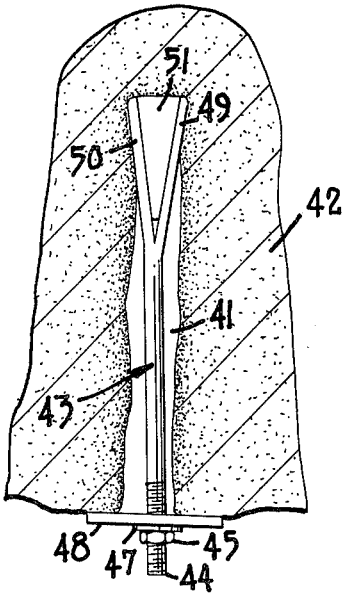
FIG. 4 is a cross-sectional view of a rock formation illustrating the use of a prior art rock bolt having an expanded bifurcated tip (i.e. a slotted bolt).
Figure 5:
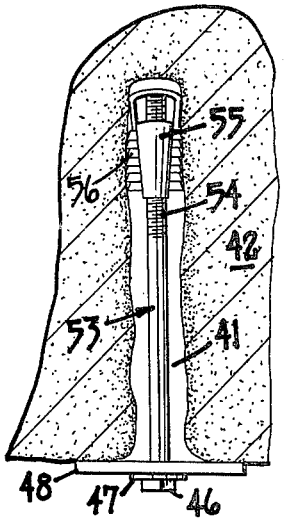
FIG. 5 is a cross-sectional view of a rock formation illustrating the use of a prior art rock bolt having an expandable mechanical anchor with several moving parts.

FIGS. 4 and 5 illustrate two prior art methods used for anchoring the inner ends of rock bolts in their respective holes.

As shown in FIG. 4, a hole 41 has been drilled into rock formation 42. A rock bolt generally designated as 43 has been inserted into hole 41. The lower end 44 of rock bolt 43 is threaded to thereby permit the lower end of rock bolt 43 to be secured against the lower face of rock formation 42 by means of nut 45, washer 47 and bearing plate 48. The upper or anchored end of rock bolt 43 is bifurcated into upwardly divergent legs 49 and 50. Placed between these two legs 49 and 50 is a separate spreader or mechanical wedge 51. Before the rock bolt shown in FIG. 4 is used, the legs 49 and 50 are only slightly separated and the mechanical wedge 51 is inserted and carried only part way between legs 49 and 50. The rock bolt 43 with wedge 51 in place is then pushed into hole 41 until the upper face of wedge 51 contacts the upper terminus of hole 41. Then, the rock bolt 43 is forced in an upward direction (e.g. by pounding on the lower end 44 of rock bolt 43 with a sledge). This forces legs 49 and 50 upwardly and outwardly over the inclined faces of wedge 51, thereby forming a tight mechanical anchor in the rock as legs 49 and 50 are forced into the rock sides of hole 41. Bearing plate 48, washer 47 and nut 45 are then placed on the lower end of rock bolt 43, and nut 45 is tightened to thereby place the rock bolt under tension.

In a somewhat similar fashion, FIG. 5 illustrates another prior art rock bolt anchoring system that uses an expandable shell equipped with annular teeth or ribs. The rock bolt shown in FIG. 5 differs from the rock bolt shown in FIG. 4 in the construction of its upper end and in the mechanical system used to anchor the rock bolt into bore hole 41. As shown in FIG. 5, the rock bolt which is generally designated by the numeral 53, has a threaded upper end 54 which passes through an internally threaded expansion member 55 which is in the form of an inverted wedge. This inverted wedge 55 is contained within an expandable anchoring shell 56. In use, the rock bolt 53 is inserted into the bore hole with threaded element 55 positioned well up within expanding anchoring shell 56. Once the rock bolt has been fully inserted into the bore hole 41, the shaft of rock bolt 53 is rotated by turning head 46 with a wrench so as to cause the threaded member 55 to be moved downwardly (without rotation) relative to the static movement of expandable anchoring shell 56. As element 55 moves downwardly relative to the expandable shell 56, the annular ribs or teeth of expandable shell 56 are forced outwardly and lock in place in the sides of hole 41 within rock formation 42. This securely anchors the upper portion of rock bolt 53 to the rock. In this way, the lower portion of rock bolt 53 is securely positioned on the lower face of rock formation 42 and the entire rock bolt placed under tension.

Other types of rock bolting systems are also known.

For example, on some projects, the rock is reinforced with rebars, which are grouted into the holes with cement. Rebars are deformed steel bars, similar to those used to reinforce concrete. The deformation is typically in the shape of skewed annular or helical ridges along the surface of the steel bars. The principal advantages of cement grouting are that the bolt and the rock are both protected against the effects of air and moisture, and the anchor stresses are distributed over the entire length of the rebar (i.e. they are not concentrated at the upper end of the bolt). The disadvantages are cost (which is higher than for simple mechanical systems) and inconvenience (since grout has to be mixed and pumped into the holes, and the pumps have to be cleaned). The problems are less significant on major civil engineering projects where the bolting process is continuous than they are in mines where only a dozen bolts or so may be installed at one time.

Combination bolt systems are also known. These systems are a hybrid between rebars and conventional bolts where the rebar segment of the combination is grouted.

Another prior art technique is called "resin bolting". The general idea of resin bolting is that one or more packets or cartridges of resin, catalyst and filler are placed in the hole, then a rebar is thrust and/or spun into the hole, rupturing the cartridge and mixing the resin and catalyst. The claimed advantages of resin bolting over mechanical anchorage are that the rebar and rock are both protected against the effects of air and moisture, and the anchorage is distributed over the full length of the rebar. The advantage of resin bolting over cement grouting is convenience. There is no need to pre-mix the resin grout or to clean pumps and hoses. However, the principal disadvantage of resin bolting is cost, which is substantially higher than for mechanical or cement-grout anchorage, but in some operations those higher initial costs are offset by the permanence of the installation.

Still another anchoring system for rock bolts involves a combination of mechanical and resin anchoring. In this system, resin and catalyst in two compartments of a foil envelope are mixed and kneaded, then the envelope is pushed into the hole ahead of a rock bolt equipped with a standard expandable mechanical anchor. The general idea is that the package will burst and the resin will flow and fill the voids around the mechanical anchor, thereby increasing the contact area of the mechanical anchor and preventing deterioration (e.g. spalling) of soft rock formations.

Another new bolting concept involves a bolt in shape of a pipe, with a slit down one side. When the pipe is compressed to close the slit and then forced into a close-fitting hole, the springiness or flex memory of the steel exerts an outward force against the rock, and friction provides anchorage. Some of the claimed advantages are that anchorage is continuous; that the pin can be re-set from time to time by simply driving it deeper into the hole, and that it can yield by slipping instead of breaking under excessively high loads. The disadvantages are: (1) cost, which presently lies between mechanical and resin costs; and (2) some doubt about the effectiveness of the anchorage.

Still another system uses a cartridge which contains encapsulated resins and catalysts arranged in such a way that the bolt need not be spun through the cartridge. After the cartridge has been inserted in the hole, thrusting and crushing the cartridge and its capsules with the bolt is claimed to provide adequate mixing.

The rock bolt anchoring system of the present invention consists of two complementary components. The first is the rock bolt anchor which is carried by the rock bolt and the second is the hardenable grout.

The Rock Bolts

The rock bolts of the present invention are similar in many respects to conventional rock bolts. Thus, they will typically include an elongated shaft (e.g. 40–2000 centimeters long, usually 100–500 centimeters long). The shaft is customarily rod-like and generally made of steel. Usually the bolt will be solid (i.e. not hollow). The rock bolt will have a first (or inner) end and second (or outer) end. The special anchor (which is described below) is located at the inner end of the rock bolt shaft. The outer end of the shaft has some type of bolt restraining device, usually either a head or threads (to accommodate one or more internally threaded nuts), which allows the outer end of the rock bolt to support and be restrained by a suitable bearing plate which covers the drilled hole opening and embraces the outer face of the exposed rock structure. The exterior surface of the rock bolts may be smooth or contoured (e.g. ridged or grooved). A smooth surface is preferred.

The Rock Bolt Anchors

The inner ends of the present rock bolts are unique in that they use a non-expandable or "fixed" wedge principle for anchoring the inner end of the rock bolt to the grout which is locked against the rock formation within the hole with no independent movement of mechanical parts being needed to wedge the upper end of the rock bolt into the hole against the rock formation for anchoring purposes (i.e. the present rock bolts have non-expanding anchors). The shape of the wedging element at the inner end of the rock bolt is such as to provide an enlarged element or portion at the inner end of the bolt, which element has an outwardly facing tapered surface relative to the bolt axis with the greatest enlargement occurring at the innermost end of the bolt. The tapered surface should have an angle of taper (measured from the bolt axis) of between 2 and 22 degrees, preferably between about 5 to 15 degrees. The wedge porition of the rock bolt anchor may be shaped as a frustum (or series of frustums, preferably of the same size and shape) which are usually and preferably symmetrically and axially aligned with the bolt axis, each of which has its largest radial dimension closest to the innermost end of the rock bolt and which has one or more tapered sides (e.g. a continuous or step-wise taper) each with the above-mentioned angle of taper.

Figure 6:
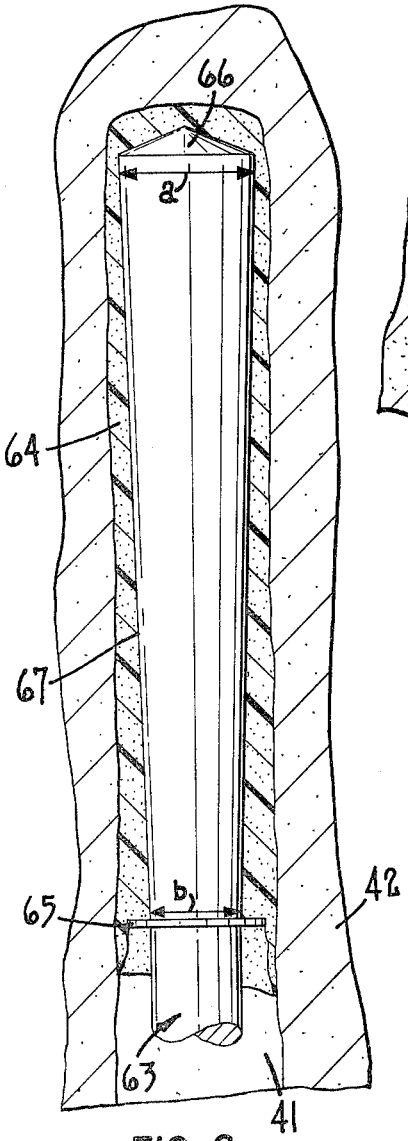
FIG. 6 is a fragmentary cross-sectional view of a rock bolt which has been anchored in a rock formation with one of the rock bolt anchors of the present invention.

The wedge-like shape of the rock bolt anchors of the present invention can be better understood by reference to FIG. 6. As shown in FIG. 6, a hole 41 has been cut into a rock formation 42. A grout 64 has been introduced into the upper reaches of hole 41 and the rock bolt 63 is inserted and then locked into place by the hardening of the grout. A wedge-shaped rock bolt anchor 66 is carried at the inner end of rock bolt 63. As shown in FIG. 6, the upper-most portion of the symmetrical wedge shaped section 66 of rock bolt 63 has a laterally or radially extending dimension "a" (called the "head of the wedge or anchor") which is greater than the dimension "b", (which is called the "foot of the wedge or anchor"), thereby creating a slightly inclined or tapered outer surface 67 which is at an angle of 2–22 degrees relative to the longitudinal axis of rock bolt 63. Thus, the upper or anchor portion of rock 63 is a frustum in the form of an inverted, truncated cone which provides a wedging action that restrains the rock bolt against efforts of withdrawal only after the grout 64 has hardened in place. An optional but desirable annular collar 65 is provided to prevent any substantial amount of grout 64 from escaping from the zone of the rock bolt anchor before the grout has had an opportunity to harden in place. If desired, the upper face 66 of the rock bolt anchor can be smooth (as shown) or it can be provided with flanges, teeth, etc. to aid in mixing grout or to rupture any package for the grout when it is prepackaged (e.g. in a sausage or cartridge).

If desired, the inverted wedge which serves as the rock bolt anchor for rock bolt 63 can be fabricated (e.g. forged) as an integral part of the shaft of rock bolt 63 or it can be formed separately (i.e. the rock bolt anchor can be a separate unit) and attached to the shaft of rock bolt 63 by some convenient means (e.g. a threaded connection) which may penetrate the entire wedge-shaped anchor. Similarly, annular collar 65 can be formed integrally with rock bolt 63 or it can be formed separately and attached to rock bolt 63 by suitable means such as welding or by being retained between the ends of the shaft of rock bolt 63 and a separate rock bolt anchor when the two parts are formed separately and screwed or otherwise connected together.

Figure 7:
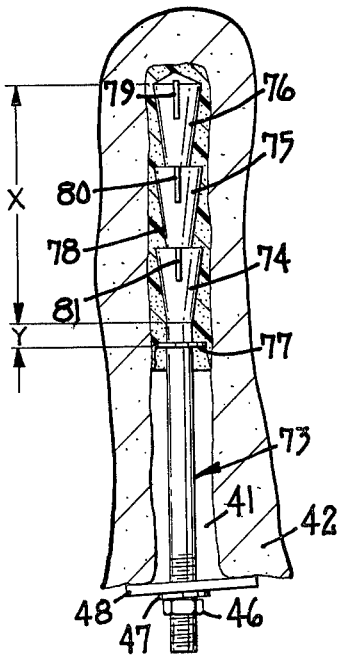
FIG. 7 is a cross-sectional view of a rock formation into which has been anchored a rock bolt using a second embodiment of the present invention.

FIG. 7 shows an alternative embodiment of the rock bolt and anchor of the present invention. In FIG. 7 the rock bolt is generally designated by the numeral 73 and is shown inserted in place in hole 41 which has been formed in rock formation 42. At the upper end of rock bolt 73 is a rock bolt anchor which comprises a series of three stacked wedge elements 74, 75 and 76 which are each in the form of inverted, truncated cones. Rock bolt 73 further optionally includes a grout-retaining ring 77 that serves to retard the flow of grout 78 from the hole 41 so the grout can harden in place around wedge elements 74, 75 and 76 to thereby secure or lock the rock bolt in place. Further, the ring prevents a large collar of grout from forming below the collar along the shaft of the rock bolt. Such collars of grout are undesirable and can interfere with the optimum operation of the present bolt anchoring system.

As shown in FIG. 7, each of the wedge elements 74, 75 and 76 optionally includes one or more outwardly projecting flanges 79, 80 and 81. The function of these flanges (and others of a similar nature which may be carried by the same wedge element) is to prevent unwanted rotation of the roof bolt 73 within the grout as the nut 46 is tightened to place the rock bolt under tension and secure the bearing plate 48 to the base of the rock formation 42. Further, the flanges promote splits or fractures in the hardened grout to thereby permit the hardened binder or grout to be forced out laterally as the wedge is pulled downwardly in contact with the grout which places the grout under compression. This splitting action helps to keep the grout in place rather than allowing it to be pulled out of the hole with the rock bolt anchor as load is applied to the rock bolt.

Figure 8:
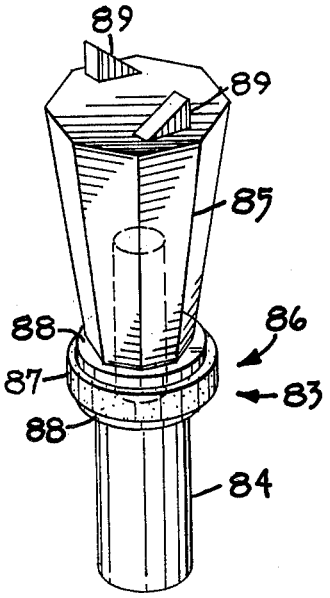
FIG. 8 is a fragmentary perspective view of a third type of rock bolt anchor made according to this invention.

FIG. 8 shows a further alternative embodiment of the present invention. In FIG. 8, the rock bolt is generally designated by the numeral 83. The shaft 84 is a solid cylindrical rod having its upper end threaded to connect with a polyhedral shaped wedge element 85. An annular ring generally designated as 86 is held between the shaft 84 and the lower end of the wedge-shaped anchor 85. The ring is actually a resilient plastic seal 87 sandwiched between two rigid metal washers 88 of slightly smaller diameter. The upper face of the wedge section 85 is provided with a series of teeth 89 to assist in rupturing pre-packaged grout and/or mixing binder or grout. The converging edges of the wedge will promote fracture of the hardened grout, similar to flanges 79, 80 and 81 of FIG. 7.

Figure 9:
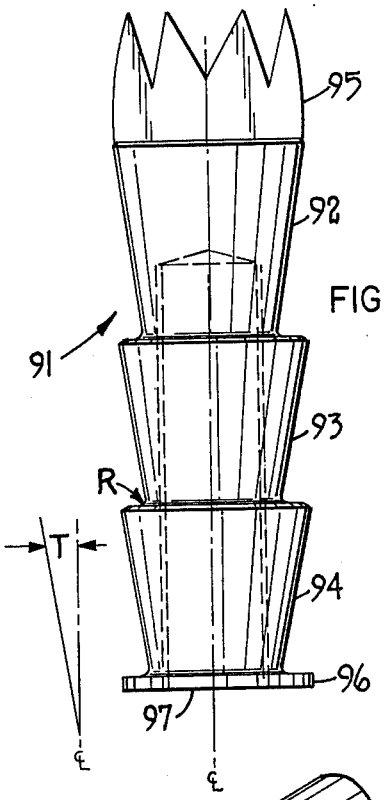
FIG. 9 is a side elevational view of a preferred type of rock bolt anchor made according to this invention.

FIG. 9 shows a plan view of a preferred type of rock bolt anchor made according to the present invention. In FIG. 9, the rock bolt anchor (which is intended to be threadably attached to a rock bolt shaft) is generally designated by the numeral 91. The rock bolt anchor comprises a series of three stacked wedge elements 92, 93, and 94, each of which is in the form of an inverted, truncated, cone. The top of section 92 is generally flat except for the sharp, multi-pointed crown which is intended to assist in rupturing containers of pre-packaged grout and to help mix the grout components as the rock bolt is rotated. An annular flange or ring 96 is integrally formed at the foot of wedge section 94 to restrain the flow of grout and cause it to remain adjacent to and in the zone of the wedge elements 92, 93 and 94 as the grout hardens, to thereby mechanically interlock the rock bolt anchor through the grout to the rock formation. The rockbolt anchor 91 is drilled and tapped 97 to receive the threaded end of a rock bolt shaft. The angle of taper "T" of each wedge element 92–94 is within the range previously indicated (e.g. 5°–15°).

Figure 10:
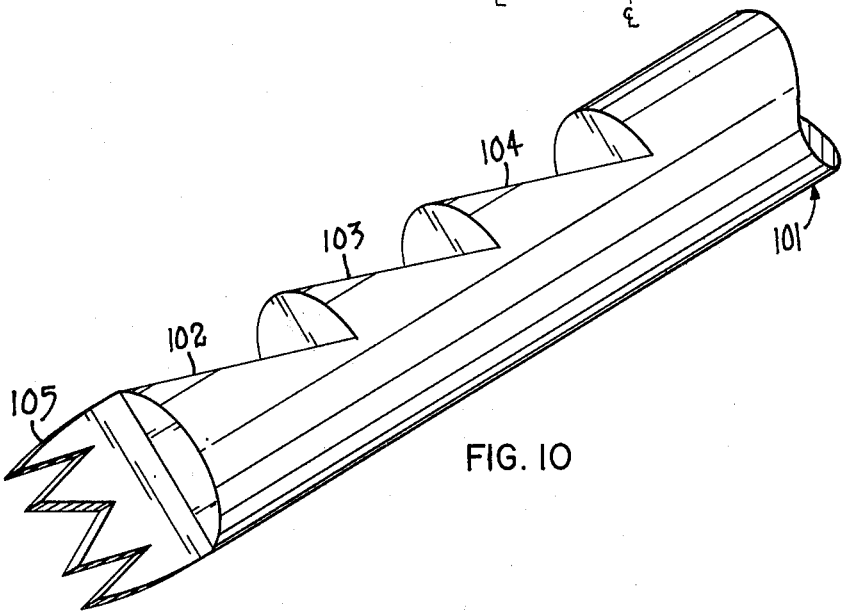
FIG. 10 is a fragmentary perspective view of another type of rock bolt anchor made according to this invention.

FIG. 10 shows a further alternative embodiment of the present invention. In FIG. 10, a rock bolt is generally designated by the numeral 101. Along the inner end of rock bolt shaft 101 have been formed a series of stepped notches 102, 103 and 104 which can provide wedging action against the hardened grout. Although this design is not preferred from a technical standpoint because of such factors as lack of symmetry and the use of excess metal, it does offer some manufacturing advantages and adequate anchorage can be achieved for some purposes if a sufficient number of the notches (or even very deep annular grooves) are present and the grout is properly applied adjacent to the notches.

Suitable Grouts

Suitable grouts for use in the present invention include those organic and inorganic grouting compositions which can be introduced into a hole 41 in an unhardened state and which will or can be quickly hardened in place to anchor the present rock bolts within their respective holes. Such grouts are typically introduced into the bore hole in liquid or semi-solid form and may, if desired, be prepackaged in capsules or other thin-walled containers (e.g. foil pouches) which can readily be ruptured when the rock bolt is inserted into the bore hole and forced into contact with the grout package. Thickeners and thixotropic agents can be included in the grout compositions for flow control.

The pre-packaged grouts (e.g. in a foil or capsule package) can be designed to be inserted into a hole separate from (i.e. before) or at the same time as the rock bolt. If desired, such packages can be carried by and above the wedge-shaped bolt anchor of the bolt or wrapped around the bolt anchor.

Not all grouts serve with equal effectiveness and the best grouts are those which satisfy the optimum number of the following criteria usually as determined on a cost/effective basis:

1. Are easy to introduce into the type, location, and orientation of the holes being used.

2. Readily fill the innermost portion of a hole and easily conform to the shape of the hole and the inner or wedge shaped end of the rock bolt.

3. Harden in place quickly after a rock bolt (with anchor) has been inserted into the hole and do so without significant shrinkage. Fast curing grouts can be used because the present system requires much less grout than is required to grout an entire bolt or rebar.

4. When hardened, provide a strong mechanical interlock with the tapered or wedge portions of the specially designed rock bolts. In this regard, mechanical strength under compression and good cohesive strength rather than adhesive bonding to the rock bolt and associated shear strength is of primary importance.

For underground mining purposes, the grout selected should be one which will quickly harden sufficiently to support the weight of the improved rock bolt after it has been inserted into an overhead hole, yet not harden so quickly that the grout becomes hard before the rock bolt and anchor can be inserted into the grout and the grout can conform to the shape of the tapered end of the rock bolt to secure or mechanically interlock it in place.

With these considerations in mind, suitable grouting compositions can be prepared or selected from among the following active ingredients:

(a) Inorganic grouts such as fast hardening cement mixtures, desirably of a putty-like consistency at the time of introduction into the bore hole.

(b) Organic grouts such as polyester resins, polyisocyanates, polyurethanes, epoxy resin and phenolic resin systems, etc. As is customary in the resin art, the rate of hardening can be accelerated by the use of catalysts or coreactants with the amount of catalyst or coreactant used being determined by the particular system employed and the desired rate of reaction.

Thus, any multi-part organic curable resin system in which the major components are capable of forming a hard resin upon curing can be used as the grout. In this regard, the use of organic resins for rock stabilization and for anchoring rods or bolts in rock or masonry is well known. See, for example, U.S. Pat. Nos. 2,952,129; 3,108,443; 3,324,663; 3,698,196; 3,877,235 and 3,925,996. Although resin systems curable under ambient conditions are greatly preferred, in some applications it may be possible to supply heat to the mixture; for example, by heating the rock bolt or anchor before insertion. Curable systems which generate gas upon curing produce a foamed resin, and the pressure generated by the gas is advantageous in assisting the mixing of the components and in forcing the resin-forming mixture into any cracks or fissures in the walls of the hole, which reinforces the surrounding rock formation. Foaming curable systems are therefore particularly desirable for many applications, such as mine roof reinforcement. Epoxy resin systems are described in United States Bureau of Mines Reports of Investigation Nos. 5439 (E. R. Maize and R. H. Oitto, Jr., 1959) and 7907 (R. V. subramanian, H. Austin, R. A. V. Raff and J. C. Franklin, 1973), the former also including polyester type resins. Polyurethane, melamine- or ureaformaldehyde systems are also very useful. See U.S. Pat. No. 3,698,196 and Gluech Auf, Vol. 108 pages 582–4 (Alfons Jankowski). Liquid curable systems in which all the reactants are liquid under the ambient conditions of use are preferred to facilitate mixing and to improve resin impregnation of the surrounding rock or earth structure. The water curable systems have the advantage of curing in water-wetted structures, e.g., damp rock formations in underground mines.

Among the organic grouts, the following are illustrative: acid catalyzed (e.g. oxalic acid catalyzed) melamine-formaldehyde pre-polymers, epoxy resins such as bisphenol epichlorohydrin resins cured with polyamines; acid cured phenol-formaldehyde resins; furan resins; and the like. Particularly preferred grouts for use in the present invention are polyesters. Suitable polyesters are those unsaturated polyesters (e.g. maleic anhydride/phthalic anhydride polyesters) having a low acid number (e.g. below 75) which can be cross-linked or hardened with polymerizable monomers having ethylenic unsaturation (e.g. styrene or vinyl toluene), usually with a catalyst or promoter (e.g. benzoyl peroxide). Polyesters having high acid numbers (e.g. above 150) such as those made from pentaerythritol and chlorendic acid can be cross-linked or hardened by co-reaction with poly-epoxy compounds (e.g. bisphenol epichlorohydrin resins or epoxidized vegetable oils).

For a further description of known grouts see U.S. Pat. No. 3,324,663 and the references cited therein.

METHOD OF USE AND GENERAL CONSIDERATIONS

In use, a hole is drilled in a rock formation or other structure to be reinforced. The hole does not need to be much larger than the maximum diameter of the anchor (1/16 inch is generally sufficient). Next, an anchoring amount of a suitable grout is introduced into the innermost part of the hole. This introduction of the grout occurs before or simultaneously with the introduction of the rock bolt and rock bolt anchor. It is important to note that the present invention is concerned only with applying grout to a small localized zone within the hole which is adjacent to and which surrounds the rock bolt anchor. This is directly contrary to many current practices which involve grouting a rebar or similar device along its entire length which may range up to 15 meters or more. In the present method, the grout must be introduced prior to or simultaneous with the insertion of the rock bolt and anchor and should be confined within a zone constituting substantially less than 50 percent of the length of the rock bolt, typically less than 25 percent and usually less than 10 percent of the length of the rock bolt (e.g. less than 5 percent of the length of the rock bolt). Thus, the goal is not to encase or encapsulate the entire length of the rock bolt but merely to provide a bearing surface immediately adjacent to the rock bolt anchor, which bearing surface is firmly locked into the adjacent rock formation.

As previously mentioned, the grout can be conveniently packaged into a foil pouch or sausage or similar cartridge which can be carried by or pushed ahead of the rock bolt anchor as the rock bolt anchor and rock bolt are inserted into the hole.

When the rock bolt and anchor have been substantially completely inserted into the hole, the bolt anchor is ordinarily thrust into and spun through the pre-packaged grout to rupture the grout container and cause mixing and hardening of the grout to occur. Since the grout ingredients are generally in a liquid form, there is a tendency in overhead holes for the grout to flow by gravity down past the rock bolt anchor and travel down along the rock bolt shaft. For optimum performance, this movement of the grout is unwanted. Instead, what is desired is to confine the resin into the zone immediately adjacent to the rock bolt anchor so as to completely fill the space between the wedge shaped elements and the walls of the hole. In an effort to restrain the grout in this zone, collar 65 of FIG. 6, collar, 77 of FIG. 7, collar 83 of FIG. 8, and collar 96 of FIG. 9 have been illustrated. It can be noted that the various collars shown in FIG. 6, 8, and 9 are located immediately adjacent the foot of the outermost wedge (outermost relative to the outer or open end of the hole). This is a preferred location. However, as shown in FIG. 7, the grout retaining ring 77 can be spaced slightly below the foot of the outermost wedge without causing serious problems other than perhaps a moderate waste of resin. For optimum performance and minimum resin waste, the location of the annular ring should not be further removed from the foot of the outermost wedge (distance Y of FIG. 7) than the overall length of the rock bolt anchor itself (i.e. distance X of FIG. 7 which is the length of the stack of inverted cones). However, as previously noted the most preferred location for the annular grout retaining ring is immediately adjacent to the foot of the rock bolt anchor as is illustrated in FIGS. 6, 8 and 9. Further, it has been found that a simple annular grout retaining ring is generally sufficient and there is ordinarily no advantage in using a more complex grout retaining ring of the type shown in FIG. 8.

Once the rock bolt with anchor and grout have been introduced into the hole, the grout is permitted to harden to thereby substantially completely fill the void between the rock bolt anchor and the walls of the hole. When the grout is hardened, this provides a bearing surface against which the tapered or inclined surfaces of the wedges can operate.

For best results, there should not be any significant adhesive bonding between the grout and the rock bolt anchor. Thus, the present rock bolt anchors are deliberately designed so as to permit the anchors to slip slightly within the grout to thereby cause the tapered surfaces of the rock bolt anchor to compress the grout thereby transmitting the forces on the rock bolt through the grout outwardly to the rock itself. If the rock bolt anchor cannot slide or float freely within the grout, the total strength of the anchor is less than that which is obtained when the rock bolt anchor slides within the grout. This is because the shear strength of the grout is not as great as its compressive strength. Consequently, it is desirable to provide a surface finish on the rock bolt anchor which promotes sliding or floating within the cured grout. This can be accomplished by coating the tapered surfaces of the rock bolt anchor with a lubricant, a weak primer, a foil coating, a plastic coating, or using some other technique to promote slippage.

Once the grout has hardened, the outer or exposed end of the rock bolt will be suitably tightened against a bearing plate or similar device located over the exposed end of the hole. As the tension on the bolt is increased, it will reach a point where some slippage of the rock bolt anchor occurs which converts the stress on the grout from shear to compression. Upon further tightening, a higher degree of tension can be placed on the rock bolt without causing significant further slippage.

Because a mine roof or other rock structure is not a static system, the load on an anchored rock bolt will change over time. If the load increases sufficiently, the rock bolt anchor will slide a short distance down over the inclined faces of the grout to balance the increase in load.

EXPERIMENTAL WORK

The present invention has been tested in both the laboratory and under field conditions. For laboratory test purposes, rock bolts were used which were made of $\frac{3}{4}$ inch diameter cold rolled steel 18 inches long. Four inches of $\frac{3}{4}$-10 threads were provided on each end. Yield strength was found to be 11 tons with the elastic deformation below that value being 4 mils per ton of load. Concrete cylinders were used to simulate rock strata. The concrete was in the form of 8 inch diameter cylinders both 12 inches and 15 inches long. These cylinders were tested and found to have an initial compressive strength of 7000 psi and a nominal compressive strength after 2 months of aging of 8,700 psi. After the concrete had cured, $1\frac{3}{8}$ inch and $1\frac{1}{2}$ inch diameter holes were drilled in the concrete with a rotary hammer.

The grout used for laboratory testing was a commercially available rapidly curing organic grout (FASLOC by duPont). This resin system is a two part grout encased in a plastic sausage-like bag. Mixing of the grout is achieved in place by spinning the rock bolt anchor through the bag, thus tearing it and allowing the two components contained within the bag to combine. Gel time is approximately 20 seconds at room temperature.

Pull tests were performed on various anchor systems by encasing the concrete in a steel jacket and then pulling on the exposed end of the bolt with a hand-activated hydraulic cylinder. Deflection of the bolt end was measured with a dial indicator.

After conducting initial tests to confirm the overall operability of the present concept, specific experimental tests were conducted to test the effect of such variables as taper angle, the taper surface area, taper surface condition, grout retention and resin strength.

From these tests, the following conclusions have been drawn.

Taper angle is critical. The taper angle must be within the range of about 2°–22° with taper angles of from about 5° to about 15° giving the best results.

The working surface area of the anchors (i.e. the tapered surfaces of the wedge shaped elements) is also important. Increasing the useful surface area of the tapers tends to increase the anchoring strength of the present rock bolt anchoring system. However, the ratio of increase is not on a 1:1 basis. For example, preliminary tests suggest that doubling the surface area will not double the load carrying strength of the rock bolt, but rather the strength of the anchor may be increased by a factor of less than 2.0. Further, increasing the surface area beyond that required to give an anchoring strength comparable to the tensile strength of the rock bolt is unnecessary and expensive. Desirably, the strength of the present anchoring system will approach the tensile strength of the rock bolt (e.g. it will be more than 80 percent of the tensile strength) and preferably be substantially equal to or exceed the tensile strength of the bolt. For conventional rock bolting purposes, it has been found that acceptable results can be achieved using a series of less than 10 wedge shaped elements, usually 1–5 wedge shaped elements (preferably 2–3 wedge shaped elements) with the total useful tapered surface of the anchor (regardless of the number of wedge shaped elements) having a surface area which can be from 20 square centimeters up to as high as 1000 square centimeters, usually within the range of 25–125 square centimeters, e.g. 30–75 square centimeters. Desirably, this tapered surface will be localized along the inner end of the rock bolt shaft within a longitudinal distance in centimeters equal to less than 100 percent and usually less than 50 percent of the tapered surface area (when measured in square centimeters).

Since rock types vary and rock strengths vary, the angle of taper and surface area should be selected to achieve optimum performance for any specific intended application. The larger surface areas are more useful in soft rock formations with the smaller surface areas being useful in hard rock formations.

Surface condition of the rock bolt anchor is important. Experimental test results demonstrate that rusty surface finishes and other rough surfaces tend to bond well to the grout and are not desirable on the rock bolt anchor. Coatings (e.g. organic coatings or foil or lubricants) can be applied to the surface of the rock bolt anchors to improve slippage. However, bonded lubricants such as Teflon or molybdenum disulfide are preferred over soft lubricants such as greases since the latter tend to be rubbed off the tapered surfaces when a rock bolt anchor is spun through the grout.

Test results further show that the grout must be confined to the area of the rock bolt anchor. In downwardly directed holes, this poses no problem. However, in overhead holes this problem can be avoided most easily by adding an annular collar directly below the rock bolt anchor which may be a part of the anchor itself or a separate component (e.g. a washer embraced between the rock bolt anchor and the rock bolt). Besides preventing massive leakage of the grout and preventing massive amounts of the grout from solidifying along the shaft of the rock bolt outside of the zone of the rock bolt anchor, an annular grout retaining ring can also serve to cause the grout to have its thinnest cross section and therefore weakest section immediately adjacent the annular ring or washer. When a load is applied to the rock bolt anchor, the grout will then break at the annular ring and any resin that has extruded past the ring will slide along the hole and not interfere with the sliding action of the anchor within the grout adjacent to the anchor. This effect can be made more pronounced as the diameter of the annular ring is increased beyond the diameter of the largest section of any of the wedge shaped portions of the rock bolt anchor.

It is interesting to note that when load is first applied to the rock bolt to activate the wedge-shaped anchor by causing the wedge-shaped anchor to slide a short distance within the grout, a noticeable movement of the anchor occurs. However, if the rock bolt is loaded a second time (e.g. loaded with the hydraulic jack) up to almost the same load as was applied in the initial or first loading, virtually no movement of the wedge-shaped anchor occurs. Rather, the observed movement or displacement of the rock bolt can be accounted for by the elastic bolt yield. Apparently, as the wedge-shaped anchor or taper moves through the cured grout as the force is increased, it tends to remain locked in place by the grout even when the load is released. Thus, cyclicle forces below the maximum force already applied to the rock bolt may not have a significant effect on further movement of the wedge shaped anchor in the grout (assuming that there has been no rock or grout failure).

It has also been noted that as long as one component (grout, rock or bolt) does not fail, there is less bolt movement or displacement on initial loading of the bolt (providing all other factors are constant) when the rock bolt anchor has larger taper angles. However, the strength of the anchor appears to reach an optimum level at angles of approximately 5°-15° with angles below 2° and over 22° being undesirable. At angles below 2°, the anchors slide out of the grout and at angles above 22°, the anchors tend to tear or pull the grout out of the rock.

With these various factors in mind, the following specific example is provided to illustrate a preferred form of the present invention.

EXAMPLE 1

A rock bolt anchor was fabricated from cold rolled steel according to the general configuration shown in FIG. 9 using, however, only two wedge shaped elements rather than the three shown in FIG. 9. In all other respects, the rock bolt anchor was as shown in FIG. 9. The diameter of the head of each wedge shaped element was 1.250 inches and the diameter of the annular ring was 1.300 inches. The radius ("R" of FIG. 9) at the foot of each wedge shaped element was $\frac{1}{8}$ inch and the angle of taper on these symmetrical cone-shaped wedges was 10° measured from the longitudinal axis of the rock bolt anchor. The annular ring was $\frac{1}{8}$ inch thick and the edges were left square. The mixing crown was made from flat cold rolled steel which was 0.250 inches thick and the overall height of the crown was 0.75 inches. The crown was welded to the top or innermost cone-shaped wedge. The total length of the rock bolt anchor (excluding the mixing crown) was 2.475 inches. The total tapered surface area was approximately 7 square inches (i.e. approximately 45 square centimeters). The lower or outer end of the rock bolt anchor was drilled and tapped to a depth of 2 inches with $\frac{3}{4}$ inch $\times$10 threads. The surface of the rock bolt anchor was lightly filed to remove coarse lathe marks created during fabrication. The entire rock bolt anchor was then coated with a thin film of a molybdenum disulfide based, bondable lubricant (Molykote 321-R of Dow Corning Corporation, Midland, Michigan). The anchor was then screwed onto the end of a 19 millimeter ($\frac{3}{4}$ inch) diameter by 46 centimeter (18 inches) long rock bolt having both ends threaded. The rock bolt was screwed into the rock bolt anchor to the full depth of the internal threads.

Next, $\frac{1}{2}$ (approximately 175 grams) of a commercially available roof bolt resin cartridge (46 centimeters $\times$23 millimeters diameter) was placed into an overhead hole which was 35 millimeters ($1\frac{3}{8}$ inch) in diameter and 30 centimeters deep which had previously been drilled into the shale roof of an underground copper mine. The resin cartridge was of a two compartment design as described in published U.S. patent Application No. B-417,299. The resin cartridge contained 12 parts by weight of a resin portion and 1 part by weight of catalyst portion. The resin portion contained a polymerizable unsaturated polyester resin prepared from o-phthalic acid, fumaric or maleic acid, propylene glycol, diethylene glycol and trimethylene glycol, together with styrene monomer and ground limestone as calcium carbonate. The catalyst portion of the resin cartridge consisted of a mixture of benzoyl peroxide, a plasticizer, and calcium carbonate. A commercially available source of a resin cartridge meeting this general description is sold under the brand name "FASLOC" by du-Pont Company.

The rock bolt and anchor assembly was then inserted into the mine roof hole which contained the partial resin cartridge and the entire rock bolt assembly was then rotated for 15 seconds while being pushed to the upper end of the hole and through the resin cartridge. The rock bolt assembly was held motionless for 15 seconds to allow the mixed resin to cure sufficiently to support the weight of the rock bolt assembly. The resin cured in approximately 30–40 seconds. After 15 minutes, the anchored bolt was pull tested.

In this test procedure, a hollow hydraulic jack was placed over the exposed end of the anchor bolt and a deflection guage was attached to the end of the bolt. The bolt was then pulled in tension to an 8 ton limit and the deflection of the bolt was noted. The load was released and the deflection guage was again reset to 0. A second load was then applied to the rock bolt up to a total load of 11 tons which was the elastic limit of the bolt. A graph was then made of the deflection (in mils) of the bolt (plotted along the X axis of the graph) versus the loading force in tons (plotted along the Y axis). From this data, the anchorage characteristics of the system were determined using a formula in which the "anchorage characteristic" is defined as the reciprical slope of the graph minus the bolt stretch and is given in units of mils per ton. In this example, the bolt stretch is 4 mils per ton. On the first load or pull, the anchorage characteristic was 15.8. On the second loading, a generally 2-sloped curve resulted with the first slope having an anchorage characteristic of 0.2 mils per ton from 2 to 7 tons of applied load and the second slope having an anchorage characteristic of 8.3 mils per ton when the load was increased from 7 to 11 tons.

OTHER APPLICATIONS

While the present invention has been described with particular reference to the anchoring of rock bolts of the type commonly used in mines and other engineering projects, the same concept can be used to achieve sound anchoring in other environments and for other applications (e.g. as anchors for ornamental and structural materials in concrete).

I claim:

1. A non-expanding, grout-activated anchor, said anchor comprising at least one wedge-shaped portion which has a head, an angle of taper of 2°–22° from said head relative to the longitudinal axis of the anchor, and sufficient tapered surface area to secure the anchor in a hole when the anchor is restrained against pull-out by a grout which fills the hole proximate the anchor; wherein portions of said anchor engaged by grout is treated so that grout does not adhere thereto.

2. Anchors of claim 1 which are asymmetrical.

3. Anchors of claim 1 in which each wedge-shaped portion is in the form of an inverted polyhedral frustum.

4. Anchors of claim 1 in which each wedge-shaped portion is in the form of an inverted truncated cone.

5. Anchors of claim 4 in which the number of truncated cones is 1–5.

6. Anchors of claim 4 in which the number of truncated cones is 2–4.

7. Anchors of any of claims 1–6 which include an annular grout-retaining ring located below the foot of the outermost wedge shaped portion.

8. Anchors of claim 1 in which each wedge-shaped portion is in the form of a solid, inverted truncated cone with the total tapered surface area being within the range of 25–125 square centimeters.

9. Anchors of claim 1 wherein said mixing means comprises a multi-pointed crown extending from said head.

10. Anchors of claim 9 wherein said points of said crown extending axially from said head of said wedge-shaped portion about the periphery thereof.

11. Anchors of claim 1 wherein said anchor is inserted into the hole with said grout in a fluid state and wherein said grout hardens around said anchor, and wherein said anchor includes means for fracturing said hardened grout.

12. Anchors of claim 11 wherein said fracturing means comprises flanges extending generally radially from said heads of said at least one wedge-shaped portion.

13. A one piece rock bolt anchor suitable for use with and connection to a rock bolt, said anchor consisting essentially of:

(a) a series of 2–3 inverted truncated cones stacked on the top of each other, each having an angle of taper of 5°–15° relative to the longitudinal axis of the anchor;

(b) a mixing crown carried on the head of the innermost truncated cone; and (c) an annular grout-retaining ring located at the foot of the outermost truncated cone; and (d) wherein said anchor has a surface coating to promote slippage of the anchor when the anchor is embedded in grout.

14. Anchors of claim 13 in which the diameter of the grout-retaining ring is larger than the greatest diameter of any of the truncated cones.

15. A rock bolt suitable for insertion into a preformed drill hole which is located in an exposed rock formation wherein the rock bolt can be anchored against tensile forces by wedging action between an anchoring portion of the rock bolt and a grout which is hardened around the anchoring portion of said rock bolt within said hole, said rock bolt consisting essentially of:

(a) a solid elongated bolt shaft having an outer bolt-restraining end and an inner anchoring end, said inner end being suitable for insertion into said hole;

(b) said inner end of shaft having as its primary anchoring means at least one non-expandable wedged-shaped anchoring portion which is larger near its inner end than near its outer end, said wedge shaped anchoring portion having an anchoring face displaced from the longitudinal axis of said rock bolt by an angle of 2°–22°; said wedge-shaped anchoring portion having sufficient tapered surface area concentrated along a portion of the inner end of the rock bolt to secure the rock bolt in the hole when the wedge-shaped anchoring portion is restrained against pull-out by a grout which fills the hole in the zone of the anchor; and (c) means rendering said inner anchoring end non-adherent with respect to said grout so that said rock bolt may rotate within said grout.

16. Rock bolts of claim 15 in which the anchoring portion of the rock bolt is formed integrally with the rock bolt shaft.

17. Rock bolts of claim 15 in which the anchoring portion of the rock bolt is formed separate from and is attached to the rock bolt shaft.

18. Rock bolts of claim 15 further comprising means for fracturing said hardened grout.

19. Rock bolts of claim 18 wherein said fracturing means comprises a plurality of flanges extending generally radially outwardly from said at least one non-expandable wedge-shaped anchoring portion.

* * * * *